US009771957B2

(12) United States Patent
Maier

(10) Patent No.: US 9,771,957 B2
(45) Date of Patent: Sep. 26, 2017

(54) HYDRAULIC DRIVE WITH RAPID STROKE AND LOAD STROKE

(71) Applicant: Voith Patent GmbH, Heidenheim (DE)

(72) Inventor: Anton Maier, Wiernsheim (DE)

(73) Assignee: Voith Patent GmbH, Heidenheim (DE)

( * ) Notice: Subject to any disclaimer, the term of this patent is extended or adjusted under 35 U.S.C. 154(b) by 84 days.

(21) Appl. No.: 14/857,180

(22) Filed: Sep. 17, 2015

(65) Prior Publication Data

US 2016/0084280 A1 Mar. 24, 2016

(30) Foreign Application Priority Data

Sep. 19, 2014 (DE) ..... 10 2014 218 887

(51) Int. Cl.
*F16D 31/02* (2006.01)
*F15B 15/14* (2006.01)
(Continued)

(52) U.S. Cl.
CPC ..... *F15B 15/1447* (2013.01); *B30B 15/161* (2013.01); *F15B 11/022* (2013.01); *F15B 11/0365* (2013.01); *F15B 2211/20515* (2013.01); *F15B 2211/20538* (2013.01); *F15B 2211/20561* (2013.01); *F15B 2211/27* (2013.01); *F15B 2211/7054* (2013.01); *F15B 2211/7056* (2013.01); *F15B 2211/7107* (2013.01); *F15B 2211/775* (2013.01)

(58) Field of Classification Search
CPC ..... F15B 11/022; F15B 11/036; F15B 2211/205615
See application file for complete search history.

(56) References Cited

U.S. PATENT DOCUMENTS 3,818,801 A * 6/1974 Kime ..... B29C 45/6771 60/484

FOREIGN PATENT DOCUMENTS

| | | |
|---|---|---|
| DE | 198 22 436 A1 | 10/1999 |
| EP | 0 311 779 B1 | 10/1993 |
| WO | 2011/003506 A1 | 1/2011 |

OTHER PUBLICATIONS

German Office Action dated Jun. 9, 2015 for German Application No. 10 2014 218 887.3 (10 pages).

* cited by examiner

*Primary Examiner* — Michael Leslie
(74) *Attorney, Agent, or Firm* — Taylor IP, P.C.

(57) ABSTRACT

A hydraulic drive, preferably for a hydraulic press, having a first synchronized cylinder that comprises a piston between first and second pressure chambers; at least one hydraulic pump whereby the pump outlet is hydraulically connected with the first pressure chamber of the first synchronized cylinder and the pump inlet is hydraulically connected with the second pressure chamber of the first synchronized cylinder; at least a second synchronized cylinder that comprises a piston between first and a second pressure chambers; whereby the piston of the first synchronized cylinder is mechanically movably coupled with the piston of the second synchronized cylinder; whereby the first pressure chamber of the second synchronized cylinder is hydraulically connected with the pump outlet; and whereby the second pressure chamber of the second synchronized cylinder can be connected with the pump inlet when a pressure limit in the second pressure chamber of the second synchronized cylinder is exceeded.

12 Claims, 3 Drawing Sheets

(51) Int. Cl.

| | |
|---|---|
| ***F15B 11/036*** | (2006.01) |
| ***F15B 11/02*** | (2006.01) |
| ***B30B 15/16*** | (2006.01) |

HYDRAULIC DRIVE WITH RAPID STROKE AND LOAD STROKE

BACKGROUND OF THE INVENTION

1. Field of the Invention

The invention relates to a hydraulic drive, preferably for a hydraulic press having a first synchronized cylinder that includes a first and a second pressure chamber and a piston that separates the first from the second pressure chamber and having at least one hydraulic pump that has a pump inlet and a pump outlet.

2. Description of the Related Art

Hydraulic drives of this type are well known from the current state of the art. In practice it is desirable for hydraulic drives, in particular for hydraulic drives for hydraulic presses, to provide a hydraulic drive that on the one hand provides a rapid movement of a drive piston in a so-called rapid stroke or rapid movement, and on the other hand a slower movement with great force is possible in a so-called load stroke or load movement.

Various drives are knows for this purpose from the current state of the art. In one drive with a so-called throttle control a pump is driven by a motor at constant speed. The control and changeover between rapid stroke and load stroke through control of the volume flow occurs hereby via flow resistance, for example valves. A disadvantage of such a drive with throttle control is the low efficiency due to the occurring flow losses.

Drives having a so-called displacement control system are moreover known from the current state of the art. A drive of this type may for example include a variable speed motor that drives two pumps having opposite delivery directions. The two pumps are connected with a hydraulic cylinder in such a way that the pump takes in hydraulic oil from one piston chamber of one hydraulic cylinder, whereas it moves hydraulic oil into the other piston chamber. The changeover from rapid stroke to load stroke, or respectively the speed control of the hydraulic drive, occurs through changing of the displacement volume of the pump or respectively through the change in speed of the motor. A disadvantage of such a drive with displacement control is that the motor must have a high maximum speed for the high speed in the rapid stroke, whereas a high maximum torque is required for the high force in the load stroke mode. Because of this high so-called peak performance the motor becomes large, heavy, slow and expensive.

What is needed in the art is a hydraulic drive that can be operated in a rapid stroke and a load stroke, whereby efficiency losses are avoided and whereby the motor should be able to be produced cost effectively.

SUMMARY OF THE INVENTION

The present invention provides a hydraulic drive characterized in that at least a second synchronized cylinder is provided that includes a first and a second pressure chamber and a piston that separates the first pressure chamber from the second pressure chamber, whereby the piston of the first synchronized cylinder is mechanically movably coupled with the piston of the second synchronized cylinder, whereby the first pressure chamber of the second synchronized cylinder is hydraulically connected with the pump outlet, and whereby the second pressure chamber of the second synchronized cylinder can be connected with the pump inlet when a pressure limit in the second pressure chamber of the second synchronized cylinder is exceeded. The second pressure chambers can also be referred to as load-side pressure chambers.

Pump intake and pump outlet are understood to be pump connections of the pump. The pump may be driven for example by a variable speed motor, whose direction of rotation is reversible. Consequently, in one direction of rotation the motor hydraulic fluid can be sucked in at the pump intake, whereas hydraulic fluid can be moved out of the pump at the pump outlet. When reversing the direction of rotation, hydraulic fluid can be sucked in at the pump outlet, and hydraulic fluid can be discharged at the pump intake. For this purpose the pump can be designed as a so-called four-quadrant pump. It is in particular conceivable that the pump is designed as a piston pump or gear pump. Instead of one single hydraulic pump, it is however also conceivable to provide two two-quadrant pumps that deliver in opposite directions and that are driven by a motor whose direction of rotation is also reversible.

Such a drive is especially advantageous since in rapid stroke—in other words when the pistons of the drive do not impact onto a load—when connecting the pump inlet and the pump outlet with the pressure chambers of the first synchronized cylinder, only the first synchronized cylinder is hydraulically driven or participates in the fluid exchange with the pump. The now effective piston surface is only the piston surface of the first synchronized cylinder. Due to the movable coupling of the first and the second synchronized cylinder, the piston of the second synchronized cylinder is moved due to the movement of the piston of the first synchronized cylinder. However, hydraulic fluid can only be moved from the second pressure chamber into the first pressure chamber of the second synchronized cylinder—in a circle, so to speak—so that no additional pump capacity is necessary for moving the second synchronized cylinder in the so-called rapid stroke. Only hydraulic fluid that is necessary for compensation of the compressibility of the hydraulic medium is supplied to the first piston chamber of the second synchronized cylinder. This volume of hydraulic fluid is however negligibly small. Consequently, the second synchronized cylinder does not participate in the fluid exchange with the pump.

If during movement of the hydraulic drive, in other words during movement of the pistons of the two synchronized cylinders or respectively of a pressing tool that is connected to the pistons comes into contact with an obstacle, for example with a work piece that is to be reshaped, then the second pressure chamber of the second synchronized cylinder can be connected with the pump inlet. Consequently the pump then moves fluid into the first pressure chambers of the two synchronized cylinders and out of the pressure chambers of the two synchronized cylinders. Both synchronized cylinders now participate in the fluid exchange with the pump. The effective piston surface is now the piston surface of the two synchronized cylinders, whereby greater force in the load stroke can be provided. Hydraulic fluid necessary to compensate for the compressibility is taken from the pressure tank.

An especially advantageous further development of the hydraulic drive is characterized in that a pressure relief valve is provided for the connection of the second pressure chamber of the second synchronized cylinder with the pump inlet. The pressure relief valve is thereby preferably arranged in a hydraulic line that connects the second pressure chamber of the second synchronized cylinder with the second pressure chamber of the first synchronized cylinder and is designed such that, when exceeding the pressure limit in the second pressure chamber of the second synchronized cylinder, it connects the second pressure chamber of the second synchronized cylinder with the second pressure chamber of the first synchronized cylinder. A changeover occurs then automatically based on the pressure in the second pressure chamber of the second synchronized cylinder.

An additional embodiment provides that instead of the pressure relief valve a two-way valve is provided for the connection of the second pressure chamber of the second synchronized cylinder with the pump inlet. Such a two-way valve can then, for example be controlled via a programmable logic controller (PLC).

An especially advantageous arrangement of the drive provides that a check valve is provided between the first and the second pressure chamber of the second synchronized cylinder, whereby the discharge side of the check valve is located on the side of the first pressure chamber of the second synchronized cylinder. The check valve is thus arranged so that it opens when an opening pressure is reached or exceeded. Since the pump outlet is connected with the first pressure chambers of the two synchronized cylinders, and the pump inlet is initially only connected with the second pressure chamber of the first synchronized cylinder, the pressure in the second pressure chamber of the second synchronized cylinder increases until the pressure differential between the first pressure chamber and the second pressure chamber of the second synchronized cylinder exceeds the opening pressure of the check valve. After opening the check valve hydraulic fluid can then flow from the second pressure chamber into the first pressure chamber of the second synchronized cylinder, so that in the rapid stroke mode no additional hydraulic fluid needs to be moved from the pump into the first pressure chamber of the second synchronized cylinder. It is however also conceivable to provide a two-way valve instead of the check valve for the connection of the first and the second pressure chamber of the second synchronized cylinder with the pump inlet. Such a two-way valve can then for example be controlled via a programmable logic controller (PLC).

It is especially preferred if the check valve can be opened via pilot control. This is especially advantageous since after completion of a load stroke a rapid return stroke can occur if the check valve is open and hydraulic fluid can be moved from the first into the second pressure chamber of the second synchronized cylinder. Advantageously, pressure equalization between the first and the second pressure chamber of the second synchronized cylinder occurs first in a decompression phase. If in the rapid return stroke mode the second synchronized cylinder again does not participate in the fluid exchange with the pump due to the opened check valve, a rapid return stroke can be achieved due to the movable coupling of the two synchronized cylinders when reversing the delivery direction of the pump or respectively the direction of rotation of the motor driving the pump.

It is moreover advantageous if the check valve can be hydraulically controlled in such a manner that it opens when dropping below an opening pressure in the first pressure chamber of the second synchronized cylinder. After completion of a load stroke the check valve is preferably opened only when a pressure equalization between the first and the second pressure chamber of the second synchronized cylinder has occurred in the decompression phase. For this purpose the delivery direction of the pump or respectively the direction of rotation of the motor driving the pump can be reversed, due to which hydraulic fluid can be moved out of the first pressure chambers of the two synchronized cylinders. For the hydraulic control, the dynamic pressure of a cooling or filter circuit is preferably used which is fed by a circulating pump. However, an electric control of the check valve is also conceivable, whereby a pressure sensor that is hydraulically connected with the first pressure chamber the second synchronized cylinder can be provided for detection of the opening pressure.

One especially advantageous further development of the hydraulic drive provides that the piston of the second synchronized cylinder has a larger hydraulic effective surface than the piston of the first synchronized cylinder. By providing a piston with a larger effective surface, a better power transmission can be achieved for the changeover between rapid stroke and load stroke, whereby on the one hand a faster rapid stroke can be ensured with a first synchronized cylinder having a small hydraulic effective surface and whereby on the other hand a load stoke with great force can be achieved with a second synchronized cylinder having a large hydraulic effective surface.

It is herein especially preferred if the ratio of the hydraulic effective surface of the second synchronized cylinder relative to the hydraulic effective surface of the first synchronized cylinder is in the range of approximately 2:1 to approximately 10:1. With such a ratio of the hydraulic effective surfaces of the two synchronized cylinders a fast rapid stroke as well as a load stroke having great force can be achieved.

The first and the second synchronized cylinders are advantageously arranged parallel to each other or, in an alternate embodiment, in series. With the parallel arrangement of the synchronized cylinders a movable coupling can preferably occur transversely to the direction of movement of the pistons. The pistons can hereby be connected for example by way of a yoke or a pressing tool. A movable coupling in the case of a series arrangement of the synchronized cylinders can preferably occur longitudinally to the direction of movement, whereby it is conceivable to arrange the pistons of the synchronized cylinders axially aligned and for example to weld them together.

An additional advantageous arrangement of the hydraulic drive provides that a hydraulic pressure tank is included. Such a pressure tank can for example be in the embodiment of a bladder reservoir or a diaphragm reservoir. Moreover, pressure relief valves can be provided that are arranged so that they connect the pump or the pressure chambers with the pressure thank when reaching critical pressures.

It is especially preferred if a pressure relief valve is provided which is arranged in such a way that it connects the second pressure chamber of the first synchronized cylinder with the pressure tank when exceeding a pressure limit in the second pressure chamber of the first synchronized cylinder. The pressure limit is thereby preferably selected to be considerably lower than the maximum operating pressure of the hydraulic drive. If now the delivery direction of the pump or respectively the direction of rotation of the motor is reversed in a decompression phase, fluid that is being compressed in the decompression phase in the second pressure chamber of the first synchronized cylinder can be diverted via the pressure relief valve to the pressure tank.

The objective of this invention is also met by a method to operate a hydraulic drive, having a first synchronized cylinder that includes a first and a second pressure chamber and a piston that separates the first from the second pressure chamber, having at least one second synchronized cylinder that includes a first and a second pressure chamber and a piston that separates the first from the second pressure chamber, and having at least one hydraulic pump that includes a pump inlet and a pump outlet, whereby the piston of the first synchronized cylinder is mechanically movably coupled with the piston of the second synchronized cylinder. In such a method the pump moves hydraulic fluid in a rapid stroke into the first pressure chamber of the first synchronized cylinder and moves hydraulic fluid out of the second pressure chamber of the first synchronized cylinder, whereby hydraulic fluid is moved from the second pressure chamber of the second synchronized cylinder into the first pressure chamber of the second synchronized cylinder, whereby when exceeding a pressure limit in the second pressure chamber of the second synchronized cylinder the second pressure chamber of the second synchronized cylinder is connected with the pump in such a manner that the pump, in a load stroke moves hydraulic fluid into the first pressure chambers of the first and the second hydraulic cylinder and moves hydraulic fluid out of the second pressure chambers of the first and the second synchronized cylinder.

Consequently, an especially advantageous operation of a hydraulic drive can be produced with such a method. On the one hand the drive can be quickly moved in a rapid stroke, whereby on the other hand a load stroke having great force can be achieved. Changeover from rapid stroke to load stroke occurs preferably on impact of the piston or respectively of a tool that is arranged on the piston upon an obstruction, for example a work piece.

An especially advantageous further development of the method is characterized in that after completion of the load stroke the delivery direction of the pump is reversed, whereby the pump moves hydraulic fluid in a decompression phase out of the first pressure chambers of the first and the second synchronized cylinder, whereby the first and the second pressure chamber of the second synchronized cylinder are connected with each other in a rapid return stroke in such a manner that hydraulic fluid is moved from the first pressure chamber into the second pressure chamber of the second synchronized cylinder. Thus, a rapid return stroke can be achieved vice versa to the rapid stroke wherein only the first synchronized cylinder participates in the fluid exchange with the pump, whereby the movement of the second synchronized cylinder in the rapid return stroke occurs through the mechanical coupling of the pistons of the two synchronized cylinders.

It is moreover advantageous if the changeover from the decompression phase into the rapid return stroke occurs when the pressure in the first and in the second pressure chamber of the second synchronized cylinder is approximately the same. A return stroke movement of the two pistons can thus be initially achieved, whereby a decompression can be achieved. If the pressure in the two pressure chambers of the first synchronized cylinder is approximately the same, hydraulic fluid can be moved in the rapid return stroke from the first into the second pressure chamber of the second synchronized cylinder by way of opening of a valve.

The changeover from the decompression phase into the rapid return stroke occurs advantageously via pilot controlled opening of a check valve. The pilot controlled opening can for example occur through hydraulic activation. The check valve can be opened in opposite direction to its flow direction. It is conceivable to use a dynamic pressure of a cooling or filter circuit that is fed by a circulation pump for the hydraulic activation. However, an electric activation is also conceivable.

An additional advantageous further development of the method provides that the changeover from rapid stroke to load stroke occurs through opening of a pressure relief valve. By opening a pressure relief valve the increasing pressure that is caused by the pistons impacting on an obstruction or respectively by a pressing tool which can be arranged on the pistons impacting on an obstruction can be used to change over into the load stroke, since now the pump outlet is connected with the first pressure chambers of the two synchronized cylinders, whereas the pump inlet is connected with the second pressure chambers of the two synchronized cylinders.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
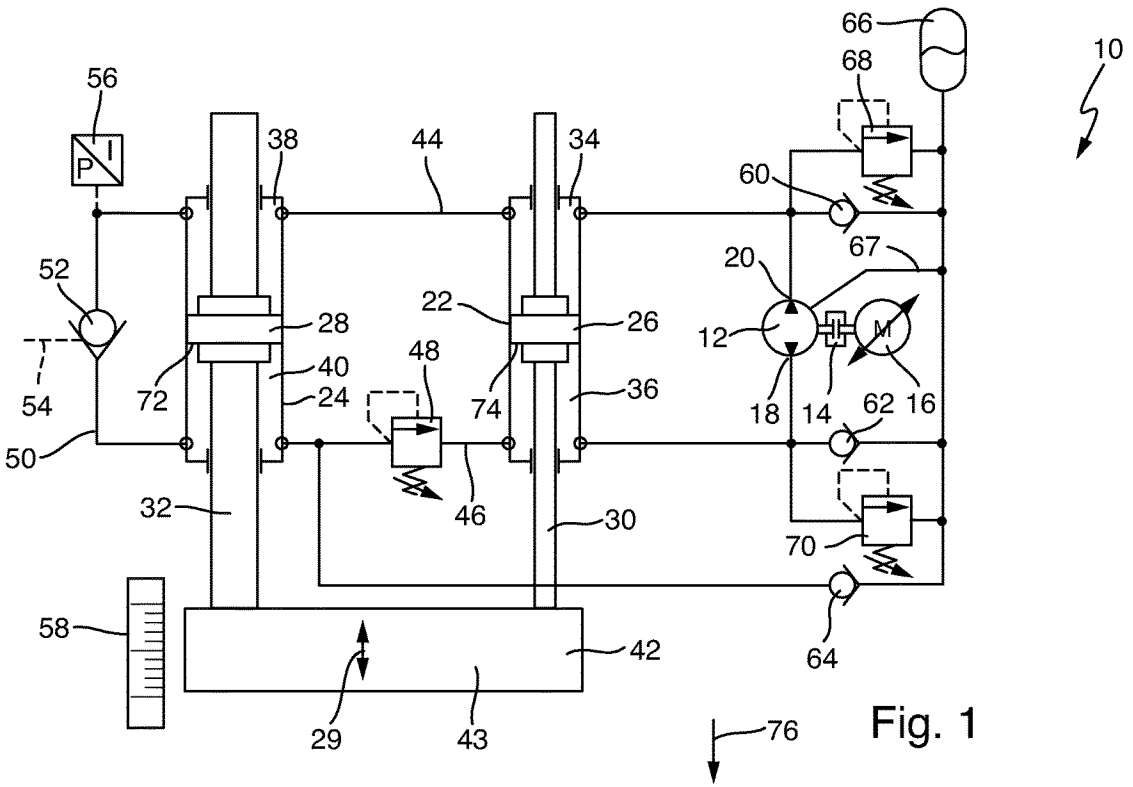
FIG. 1 illustrates a first embodiment of a hydraulic drive according to the invention.

FIG. 1 illustrates a first embodiment of hydraulic drive 10, on the basis of which the fundamental principle of the various embodiments is explained. A pump 12 is driven via a coupling 14 by a variable speed motor 16 whose direction of rotation is reversible. The motor includes a pump inlet 18 and a pump outlet 20. In one rotational direction of motor 16, hydraulic fluid can be sucked in at pump inlet 18, and hydraulic fluid can be moved out of pump 12 at pump outlet 20. When changing the direction of rotation, hydraulic fluid can again be sucked in at pump outlet 20, and hydraulic fluid can be moved out of pump 12 at pump inlet 18. Pump 12 can herein be designed as a so-called four-quadrant pump. It is in particular conceivable that pump 12 is designed as a piston pump or gear pump. Instead of one single pump 12, it is however also conceivable to provide two two-quadrant pumps that deliver in opposite directions and that are driven by a motor whose direction of rotation is also reversible.

Hydraulic drive 10 moreover includes a first synchronized cylinder 22 and a second synchronized cylinder 24. The two synchronized cylinders 22, 24 are arranged parallel to one another in FIG. 1. A piston 26, 28 is hydraulically movably arranged in each synchronized cylinder 22, 24, whereby a piston rod 30, 32 is arranged respectively on each piston 26, 28. Pistons 26, 28 can be moved up or down as is indicated by double arrow 29. Piston 26 separates first synchronized cylinder 22 into a first pressure chamber 34 and a second pressure chamber 36. Second pressure chamber 36 is shown at the bottom of first synchronized cylinder 22 in FIG. 1 and is also referred to as load-side pressure chamber.

Piston 28 separates second synchronized cylinder 24 into a first pressure chamber 38 and a second pressure chamber 40, whereby second pressure chamber 40 is also referred to as load-side pressure chamber. The two pistons 26, 28 are mechanically movably coupled on their piston rods 30, 32 at the lower end as shown in FIG. 1 that is facing away from piston 26, 28 by way of a yoke 42 which, in FIG. 1 is in the embodiment of a pressing tool 43.

Pump outlet 20 of pump 12 is hydraulically connected with first pressure chamber 34 of first synchronized cylinder 22 and first pressure chamber 38 of second synchronized cylinder 24. In FIG. 1 a hydraulic line 44 is provided which connects the two pressure chambers 34, 38 with each other. It is however also conceivable to connect both pressure chambers 34, 38 via a separate hydraulic line individually with pump outlet 20.

Second pressure chamber 36 of first synchronized cylinder 22 is connected with pump inlet 18, whereas second pressure chamber 40 of second synchronized cylinder 24 can be connected by way of a pressure relief valve 48 that is located in a hydraulic line 46 with second pressure chamber 36 of first synchronized cylinder 22, and thus with pump inlet 18. Pressure relief valve 48 opens depending on a pressure in second pressure chamber 40 of second synchronized cylinder 24, against a spring force.

Between first and second pressure chamber 38, 40 of second synchronized cylinder 24 an additional hydraulic line 50 is provided in which a check valve 52 is arranged, the discharge side of which is arranged on the side of first pressure chamber 38 of second synchronized cylinder 24. Valve 52 is pilot-controllable and has a hydraulic control line for this purpose.

For measuring the pressure in first pressure chambers 34, 38 of the two synchronized cylinders 22, 24 a pressure sensor 56 is provided, whereby moreover a position sensor 58 is provided in the region of pressing tool 43. A pressure and position controlled activation of the hydraulic drive 10 can be achieved by way of pressure sensor 56 and position sensor 58.

To avoid vacuum and cavitation, three check valves 60, 62, 64 are provided which can be opened when required, so that hydraulic fluid can be sucked from a tank or pressure tank 66 which can be in the embodiment of a membrane reservoir or bladder reservoir. Because of the exchange of hydraulic fluid between the first and the second pressure chamber of a respective synchronized cylinder it is possible to use a pressure tank with a small volume. Pressure tanks having a volume of up to 51, in particular to a volume of 21 are considered as being small volume pressure chambers.

To compensate internal leakages, pump 12 is also connected with pressure tank 66 by way of an auxiliary line 67. In order to avoid overpressure, two pressure relief valves 68, 70 are moreover provided which are hydraulically connected with pump outlet 20 and pump inlet 18 in such a manner that pump 12 can be secured against overpressure. Pressure relief valves 68, 70 open in each case against the force of a spring when a critical opening pressure at pump inlet 18 or pump outlet 20 is exceeded. Pressure relief valve 70 thereby has a considerably lower opening pressure than pressure relief valve 68 whose opening pressure is designed to the maximum operating pressure of hydraulic drive 10.

Second synchronized cylinder 24 has a hydraulic effective surface 72, whereby first synchronized cylinder 22 has a hydraulic effective surface 74. Hydraulic effective surface 72 is larger than hydraulic effective surface 74. Hydraulic effective surface 72 is preferably two to ten times larger than hydraulic effective surface 74.

According to the invention, the function of hydraulic drive 10 is now described.

Motor 16 drives pump 12 in a manner so that said pump expels hydraulic fluid at pump outlet 20 and sucks in hydraulic fluid at pump inlet 18.

Since first pressure chamber 34 of first synchronized cylinder 22 is hydraulically connected with pump outlet 20, hydraulic fluid flows into first pressure chamber 34 of first synchronized cylinder 22, whereby hydraulic fluid is sucked from second pressure chamber 36 of first synchronized cylinder 22. Piston 26 of first synchronized cylinder 22 moves thereby downward in FIG. 1. As a result of the movable coupling of pistons 26, 28 via yoke 42 or pressing tool 43, second piston 28 in FIG. 1 is simultaneously moved downward.

Since piston 28 is now also moved, hydraulic fluid in second pressure chamber 40 of second synchronized cylinder 24 is compressed to the extent that the opening pressure of check valve 52 is exceeded and check valve 52 opens. Hydraulic fluid is thus moved from second pressure chamber 40 into first pressure chamber 38 of second synchronized cylinder 24. Synchronized cylinder 24 therefore does not participate in the fluid exchange with pump 12, whereby the effective cylinder surface consists solely of effective surface 74 of first synchronized cylinder 22. Since only first synchronized cylinder 22 needs to be supplied with hydraulic fluid by pump 12, and both pistons 26, 28 can be moved due to the movable coupling, both pistons 26, 28 can be moved in a rapid stroke at low force in the direction of arrow 76. Apart from friction and leakage, no further losses occur thereby.

When hydraulic drive 10 is moved in rapid stroke, approximately the same pressure prevails in pressure chambers 34, 38, 40 since pressure equalization between pressure chambers 38, 40 can occur via check valve 52. In second pressure chamber 36 of first synchronized cylinder there is a lower pressure in rapid stroke, since hydraulic fluid is actively sucked by pump 12 from pressure chamber 36.

If yoke 42 or pressing tool 43 impacts an obstacle, for example a work piece, the pressure in pressure chambers 34, 38, 40 increases, and the pressure in second pressure chamber 36 of first synchronized cylinder 22 remains low. If the pressure in pressure chambers 34, 38, 40—in particular in pressure chamber 40—rises above the opening pressure of pressure relief valve 48, pressure relief valve 48 opens so that second pressure chamber 40 of second synchronized cylinder 24 is connected indirectly with pump inlet 18 of pump 12 via the connection with second pressure chamber 36 of the first synchronized cylinder.

Thus, after opening of pressure relief valve 48, second pressure chambers 36, 40 are connected with pump inlet 18, whereby pump 12 now moves hydraulic fluid out of both pressure chambers 36, 40. Second synchronized cylinder 24 now participates in the fluid exchange with pump 12.

When moving pistons 26, 28 downward, additional hydraulic fluid is now required for first pressure chamber 38 of second synchronized cylinder 24, which is provided by pump 12. Pump 12 now actively moves hydraulic fluid into first pressure chambers 34, 38 and out of first pressure chambers 36, 40. Instead of the sole hydraulic effective surface 74 of first synchronized cylinder 22, both hydraulic effective surfaces 72, 74 of the two synchronized cylinders 22, 24 now act together. The two pistons 26, 28 are now moved in a so-called load stroke, in other words at low speed, however with greater force. The power transmission in the load stroke compared to the rapid stroke thereby results from the sum of hydraulic effective surfaces 72, 74 of the two synchronized cylinders 22, 24.

Systemic losses occur in the load stroke that arise as a result of to the opening pressure of pressure relief valve 48 and the volume flow through pressure relief valve 48, which is determined by effective surface 72 and the momentary speed of pistons 26, 28.

After one operating phase in the load stroke, if for example processing of a (non-illustrated) work piece is completed, the hydraulic fluid in first pressure chambers 34, 38 of the two synchronized cylinders 22, 24 must be decompressed prior to returning pistons 26, 28 into their starting position by reversing the delivery direction of pump 12. For this purpose the direction of rotation of motor 16, or respectively the delivery direction of pump 12 is reversed. Pump 12 now delivers hydraulic fluid at pump outlet 20 out of first pressure chambers 34, 38, whereby the hydraulic fluid is being decompressed. In this so-called decompression phase pump 12 moves hydraulic fud through first pump inlet 18 into second pressure chamber 36 of first synchronized cylinder 22. The two pistons 26, 28 start to move upwards in opposite direction to arrow 76. Since more hydraulic fluid is moved out of pressure chambers 34, 38 than is moved into pressure chamber 36, the pressure in second pressure chamber 36 of first synchronized cylinder 22 increases to the opening pressure of pressure relief valve 70, so that excess hydraulic fluid can be diverted into pressure tank 66.

The end of the decompression phase—when the pressure is approximately the same in first and second pressure chamber 38, 40 of second synchronized cylinder 24—can be detected for example by pressure sensor 56. After the decompression phase, check valve 52 can now be opened electrically, or as shown in FIG. 1 by way of hydraulic control line 54.

The two pressure chambers 38, 40 of second synchronized cylinder 24 are thus again hydraulically connected when check valve 52 is open. Pump 12 now only moves hydraulic fluid into second pressure chamber 36 of first synchronized cylinder 22, and out of first pressure chamber 34 of first synchronized cylinder 22. Piston 26 thus moves in opposite direction to that indicated by arrow 76. As a result of the movable coupling with yoke 42 or respectively pressing tool 43, second synchronized cylinder 24 is also moved upwards. Hydraulic fluid can thereby be moved from first pressure chamber 38 through hydraulic line 50 into second pressure chamber 40 of second synchronized cylinder 24, whereby same does not participate in the fluid exchange with pump 12. Pump 12 consequently acts now only upon hydraulic effective surface 74 of first synchronized cylinder 22, as a result of which a movement in a so-called rapid return stroke can occur.

Figure 2:
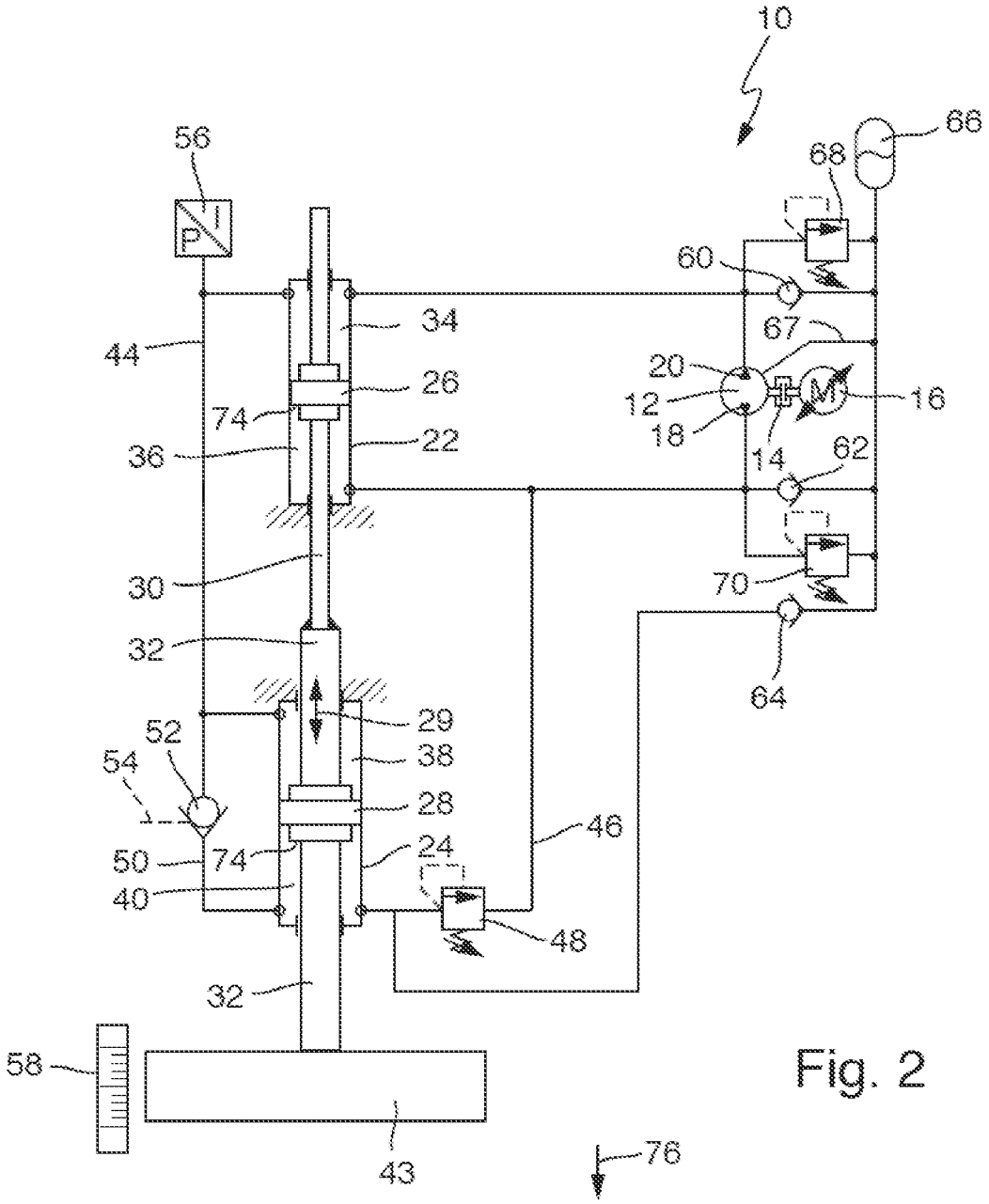
FIG. 2 illustrates a second embodiment of a hydraulic drive according to the invention.

FIG. 2 illustrates a hydraulic drive 10 according to the invention that is substantially consistent with that shown in FIG. 1.

In contrast to FIG. 1, synchronized cylinders 22, 24 are not arranged parallel, but instead in series, whereby piston rods 30, 32 are arranged axially aligned. In this case a movable coupling does not occur via yoke 42 or pressing tool 43 as illustrated in FIG. 1. Pressing tool 43 is connected only with piston rod 32 of second synchronized cylinder 24. For movable coupling of the two synchronized cylinders 22, 24 piston rods 30, 32 are connected with each other, in particular by way of a welded seam 78. For the remainder, the construction and the functionality of hydraulic drive 10 according to FIG. 2 is consistent with the design and the functionality of the hydraulic drive in FIG. 1.

Figure 3:
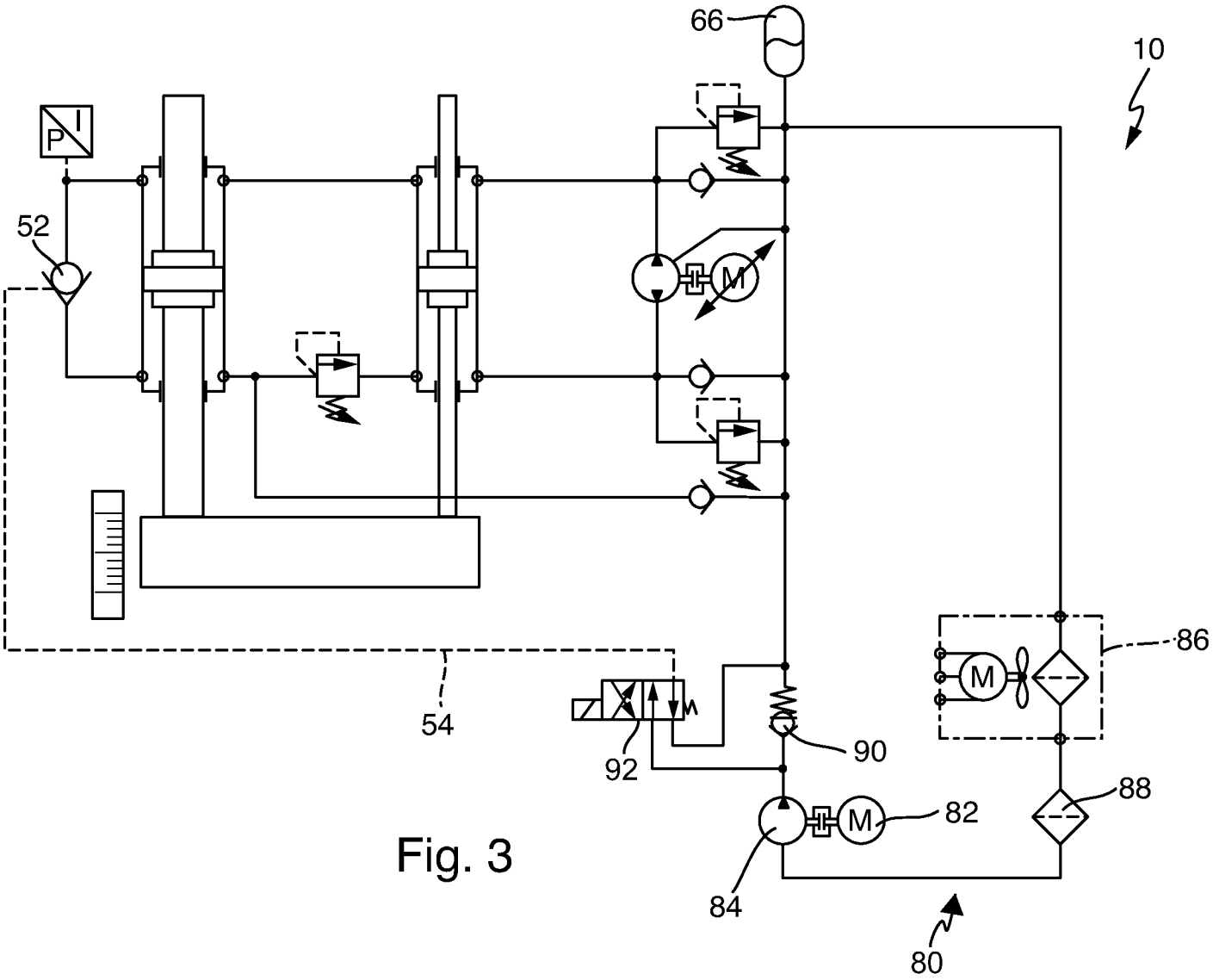
FIG. 3 illustrates a third embodiment of a hydraulic drive according to the invention.

In FIG. 3 the hydraulic drive of FIG. 1 is additionally equipped with an auxiliary circuit 80. This auxiliary circuit 80 is designed as a circuit for cooling and filtering of hydraulic fluid. Auxiliary circuit 80 includes a motor 82 that drives a circulation pump 84. Consequently, hydraulic fluid is circulated. A heat exchanger device is provided for cooling which, in its entirety is identified with reference 86. A filter 88 is provided for filtering. When circulation pump 84 moves hydraulic fluid, said fluid is moved out of pressure tank 66, through heat exchanger device 86 and filter 88 and at a check valve 90 back into the main circuit of hydraulic drive 10. Due to spring pre-tensioning of check valve 90 there is a low dynamic pressure in auxiliary circuit 80. Auxiliary circuit 80 moreover includes a switching valve 92 that connects auxiliary circuit 80 with hydraulic control line 54, so that the dynamic pressure in auxiliary circuit 80 can be used to actuate check valve 52. Having to produce an auxiliary pressure to hydraulically activate check valve 52 can thus be dispensed with.

Consequently, for changeover into the rapid return stroke only switching valve 92 needs now to be triggered, so that the dynamic pressure of auxiliary circuit 80 is available in control line 54.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydraulic drive, preferably for a hydraulic press, comprising:

a first synchronized cylinder that includes a first pressure chamber and a second pressure chamber, and a piston that separates the first pressure chamber from the second pressure chamber;

at least one hydraulic pump that has a pump inlet and a pump outlet, whereby the pump outlet is hydraulically connected with the first pressure chamber of the first synchronized cylinder and whereby the pump inlet is hydraulically connected with the second pressure chamber of the first synchronized cylinder; and at least one second synchronized cylinder that includes a first pressure chamber and a second pressure chamber, and a piston that separates the first pressure chamber from the second pressure chamber;

whereby the piston of the first synchronized cylinder is mechanically movably coupled with the piston of the at least one second synchronized cylinder;

the first pressure chamber of the at least one second synchronized cylinder is hydraulically connected with the pump outlet; and the second pressure chamber of the at least one second synchronized cylinder can be connected with the pump inlet when a pressure limit in the second pressure chamber of the at least one second synchronized cylinder is exceeded, wherein a pressure relief valve is provided for the connection of the second pressure chamber of the at least one second synchronized cylinder with the pump inlet.

2. The hydraulic drive of claim 1, wherein a check valve is provided between the first pressure chamber and the second pressure chamber of the at least one second synchronized cylinder, whereby the discharge side of the check valve is located on the side of the first pressure chamber of the at least one second synchronized cylinder.

3. The hydraulic drive of claim 2, wherein the check valve can be opened via a pilot control.

4. The hydraulic drive of claim 2, wherein the check valve can be hydraulically controlled in such a manner that it opens when dropping below an opening pressure in the first pressure chamber of the at least one second synchronized cylinder.

5. The hydraulic drive of claim 1, wherein the piston of the at least one second synchronized cylinder has a larger hydraulic effective surface than the piston of the first synchronized cylinder.

6. The hydraulic drive of claim 5, wherein a ratio of the hydraulic effective surface of the at least one second synchronized cylinder relative to the hydraulic effective surface of the first synchronized cylinder is in the range of approximately 2:1 to approximately 10:1.

7. The hydraulic drive of claim 1, wherein the first synchronized cylinder and the at least one second synchronized cylinders are arranged parallel to each other or in series.

8. The hydraulic drive of 1, wherein a hydraulic pressure tank is provided.

9. The hydraulic drive of claim 8, wherein a pressure relief valve is provided which is arranged such that it connects the second pressure chamber of the first synchronized cylinder with the hydraulic pressure tank when a pressure limit in the second pressure chamber of the first synchronized cylinder is exceeded.

10. A method of operating a hydraulic drive comprising:

providing a first synchronized cylinder that includes a first pressure chamber and a second pressure chamber, and a piston that separates the first pressure chamber from the second pressure chamber;

providing at least one hydraulic pump that has a pump inlet and a pump outlet; whereby the pump outlet is hydraulically connected with the first pressure chamber of the first synchronized cylinder and whereby the pump inlet is hydraulically connected with the second pressure chamber of the first synchronized cylinder; and providing at least one second synchronized cylinder that includes a first pressure chamber and a second pressure chamber, and a piston that separates the first pressure chamber from the second pressure chamber;

whereby the piston of the first synchronized cylinder is mechanically movably coupled with the piston of the at least one second synchronized cylinder and;

the first pressure chamber of the at least one second synchronized cylinder is hydraulically connected with the pump outlet; and the second pressure chamber of the at least one second synchronized cylinder can be connected with the pump inlet when a pressure limit in the second pressure chamber of the at least one second synchronized cylinder is exceeded;

wherein the at least one hydraulic pump moves hydraulic fluid in a rapid stroke into the first pressure chamber of the first synchronized cylinder and moves hydraulic fluid out of the second pressure chamber of the first synchronized cylinder; and hydraulic fluid is moved from the second pressure chamber of the at least one second synchronized cylinder into the first pressure chamber of the at least one second synchronized cylinder;

whereby when exceeding a pressure limit in the second pressure chamber of the at least one second synchronized cylinder, the second pressure chamber of the at least one second synchronized cylinder is connected with the at least one hydraulic pump in such a manner that in a load stroke the at least one hydraulic pump moves hydraulic fluid into the first pressure chambers of the first synchronized cylinder and the at least one second synchronized cylinder and moves hydraulic fluid out of the second pressure chambers of the first synchronized cylinder and the at least one second synchronized cylinder, wherein after completion of the load stroke the delivery direction of the at least one hydraulic pump is reversed, thereby moving hydraulic fluid in a decompression phase out of the first pressure chambers of the first synchronized cylinder and the at least one second synchronized cylinder, whereby the first and second pressure chambers of the at least one second synchronized cylinder are connected with each other in a rapid return stroke in such a manner that hydraulic fluid is moved from the first pressure chamber into the second pressure chamber of the at least one second synchronized cylinder, wherein a changeover from the decompression phase into the rapid return stroke occurs when the pressure in the first and second pressure chambers of the at least one second synchronized cylinder is approximately the same.

11. The method of claim 10, wherein a changeover from the decompression phase into the rapid return stroke occurs via a pilot controlled opening of a check valve.

12. The method of claim 10, wherein a changeover from rapid stroke to load stroke occurs through opening of a pressure relief valve.

* * * * *